US012188735B1

(12) United States Patent
Voigt

(10) Patent No.: US 12,188,735 B1
(45) Date of Patent: Jan. 7, 2025

(54) MULTI-PIECE BARREL DESIGN

(71) Applicant: Aaron Voigt, Asheville, NC (US)

(72) Inventor: Aaron Voigt, Asheville, NC (US)

( * ) Notice: Subject to any disclaimer, the term of this patent is extended or adjusted under 35 U.S.C. 154(b) by 0 days.

(21) Appl. No.: 18/219,128

(22) Filed: Jul. 7, 2023

(51) Int. Cl.
*F41A 11/04* (2006.01)
*F41A 21/18* (2006.01)
*F41A 21/48* (2006.01)

(52) U.S. Cl.
CPC ..... *F41A 21/482* (2013.01); *F41A 11/04* (2013.01); *F41A 21/18* (2013.01)

(58) Field of Classification Search
CPC ..... F41A 21/482; F41A 21/48; F41A 21/18; F41A 5/18; F41A 11/04; F41C 23/16; F41G 11/003
USPC ..... 42/71.01, 75.01–75.1
See application file for complete search history.

(56) References Cited

U.S. PATENT DOCUMENTS 5,351,428 A * 10/1994 Graham ..... F41C 23/04 42/106
6,513,274 B1 * 2/2003 Vastag ..... F41A 11/02 42/135
9,021,734 B2 * 5/2015 Voigt ..... F41A 11/04 42/75.04
11,680,765 B1 * 6/2023 Painter ..... F41A 21/44 89/16
2014/0352190 A1 * 12/2014 Voigt ..... F41C 23/14 42/73
2015/0198403 A1 * 7/2015 Bentley ..... F41C 7/00 42/75.02
2017/0131052 A1 * 5/2017 Voigt ..... F41C 9/02
2017/0321981 A1 * 11/2017 Voigt ..... F41A 17/46
2019/0033027 A1 * 1/2019 Voigt ..... F41A 11/04
2021/0114174 A1 * 4/2021 Parra ..... B25B 1/2457

* cited by examiner

*Primary Examiner* — Michael D David
(74) *Attorney, Agent, or Firm* — Bennet K. Langlotz; Langlotz Patent & Trademark Works, LLC

(57) ABSTRACT

A firearm comprising: a frame having a barrel mount facility; the barrel mount facility having a barrel engagement portion and a threaded portion; a rear barrel portion having a rear end defining a chamber and configured to connect to the barrel engagement portion; the rear barrel portion having a front end having a first mating facility; a forward barrel portion having a rear end having a second mating facility configured to connect to the first interconnection facility; the forward barrel portion having a first retention facility proximate the rear end; an elongated barrel nut having a forward end with a second retention facility configured to bias the first retention facility in a rearward direction, the barrel nut having a rear end having nut threads configured to connect with the threaded portion of the frame.

7 Claims, 2 Drawing Sheets

MULTI-PIECE BARREL DESIGN

FIELD OF THE INVENTION

The present invention relates to gun barrels.

BACKGROUND AND SUMMARY

While regulations require minimum barrel lengths, it is often desirable to have a firearm that stores more compactly.

The above disadvantage is addressed by a firearm comprising: a frame having a barrel mount facility; the barrel mount facility having a barrel engagement portion and a threaded portion; a rear barrel portion having a rear end defining a chamber and configured to connect to the barrel engagement portion; the rear barrel portion having a front end having a first mating facility; a forward barrel portion having a rear end having a second mating facility configured to connect to the first interconnection facility; the forward barrel portion having a first retention facility proximate the rear end; an elongated barrel nut having a forward end with a second retention facility configured to bias the first retention facility in a rearward direction, the barrel nut having a rear end having nut threads configured to connect with the threaded portion of the frame.

DETAILED DESCRIPTION OF A PREFERRED EMBODIMENT

Figure 1:
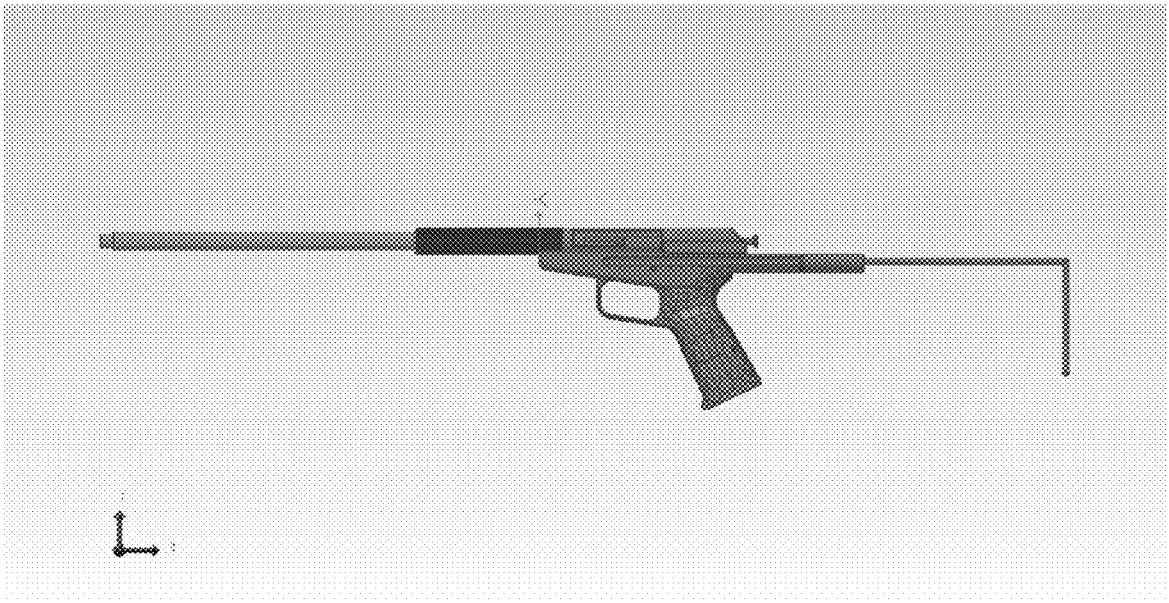
FIG. 1 is a view of a preferred embodiment of the invention.

Use FIG. 1 is one possible version of the design incorporated into a small, takedown rifle platform. The design consists of a multi-piece barrel assembly that can only be installed onto the gun as a complete assembly. Neither section of the barrel can be attached individually. As a result, a 16" or longer, legal rifle barrel can be achieved with the ability to disassemble it into smaller, more compact lengths.

Figure 2:
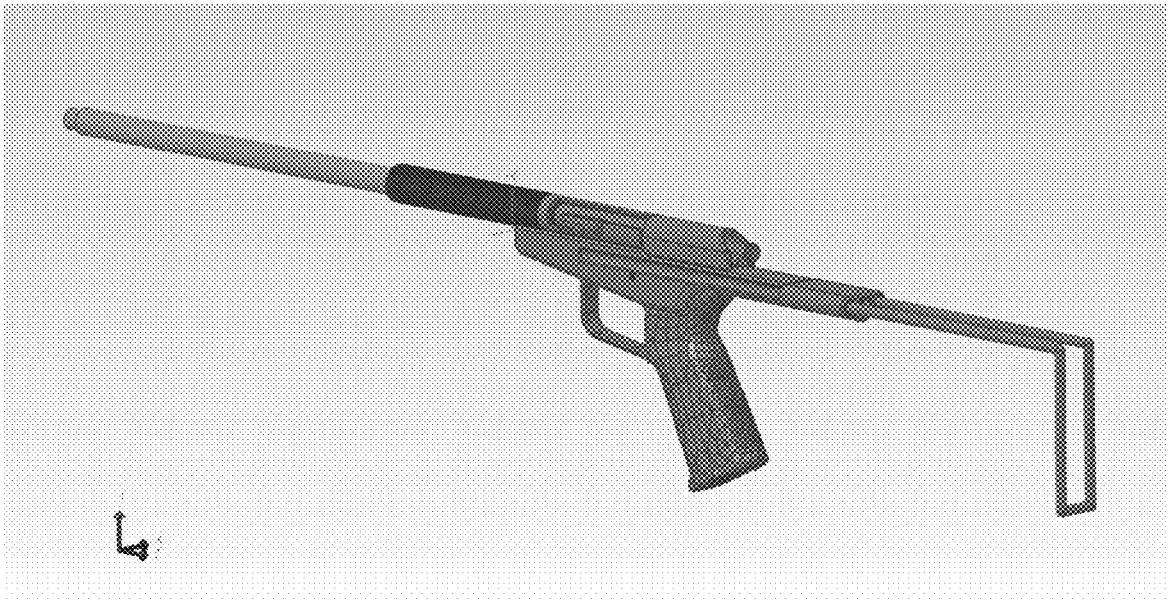
FIG. 2 is a view of is an isometric view shown above.

FIG. 2 is an isometric view shown above, this is just one possible iteration of firearm that might employ the multi-piece barrel assembly. Although this image shows a single-shot bolt-action rifle, it is noted that the application could be much broader and might include semi-auto firearms as well as repeating bolt-actions. It is also noted that this design could be utilized in a shotgun as well.

Figure 3:
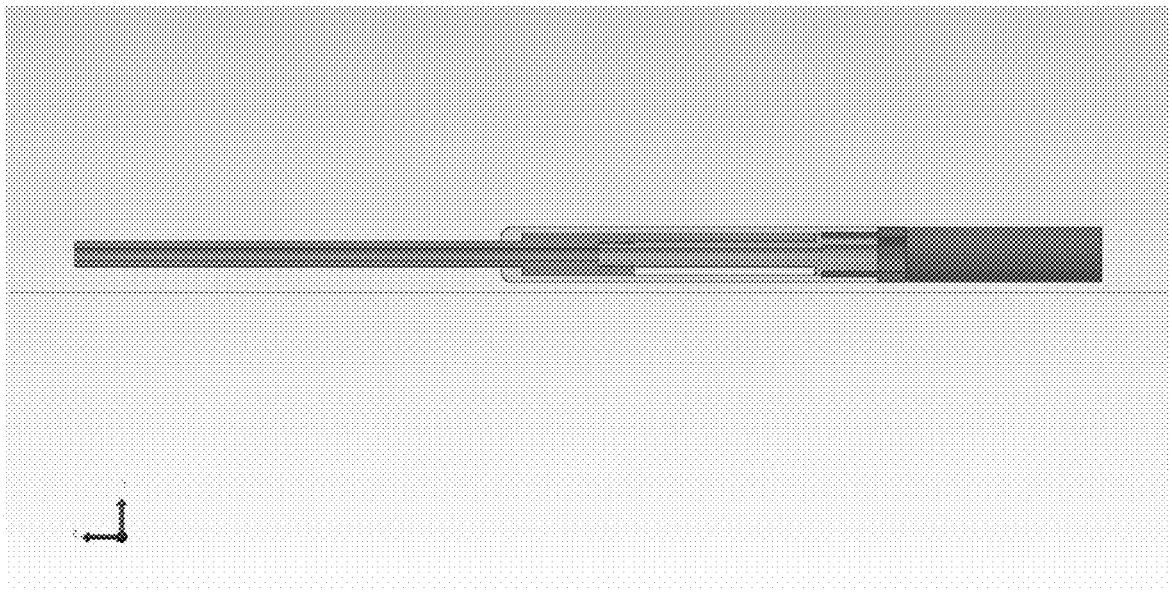
FIG. 3 is a cross section showing the barrel.

FIG. 3 is a cross section showing the barrel (in orange) on the left with the barrel extension (in blue) to the right of it. The dark grey piece represents a possible receiver, in this case for a bolt action rifle. Not all parts are shown for clarity. The barrel nut/handguard (light grey) makes up the final piece of the assembly.

Figure 4:
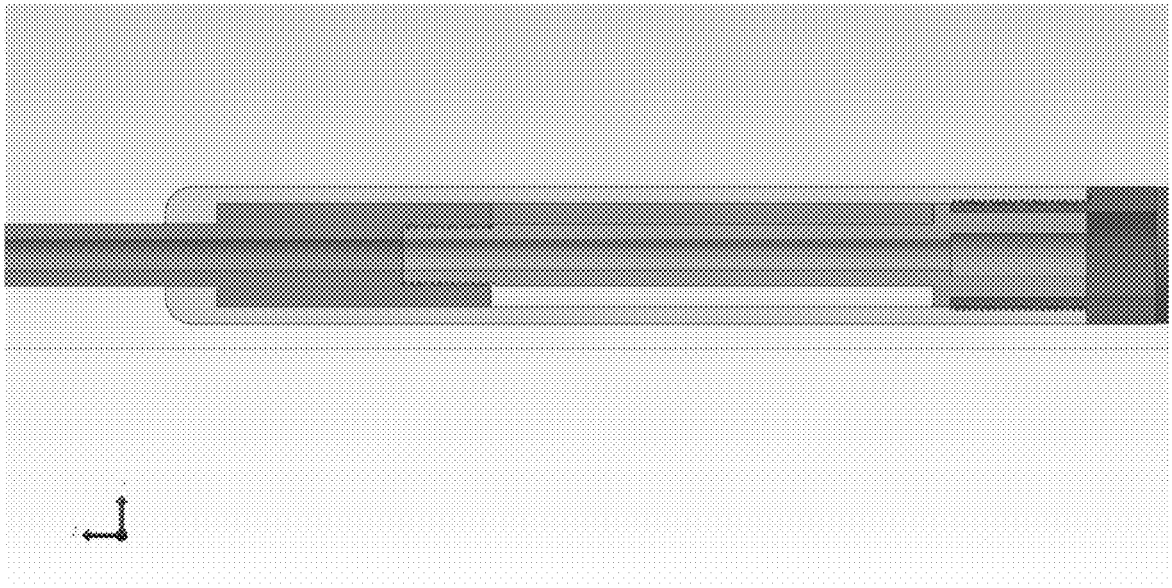
FIG. 4 is a cross section view that is zoomed in to provide additional detail.

FIG. 4 is a cross section view that is zoomed in to provide additional detail. One version of the assembly is shown with threaded connections between the barrel and barrel extension, as well as a threaded connection between the barrel nut and receiver. The shoulder of the barrel interacts with the shoulder on the barrel nut while the shoulder on the barrel extension piece interacts with the receiver. As a result, neither the barrel nor the barrel extension can be installed onto the gun individually. It is possible that both sections (barrel and extension) would be rifled in this application, but it is noted that either section could be rifled and the other smooth. It is also noted that both sections could be smooth bore in the application of a shotgun or muzzle loader. One additional application could be an integral suppressor instead of the barrel (orange) with the barrel extension (blue) serving as the barrel including the rifling.

No limitation is made to specific length of each piece, except that the assembly would achieve a 16" or greater overall length when installed into the host gun. The ATF measures barrel length with a rod inserted into the muzzle end until it reaches the breech face. Depending on the application, it is possible that the barrel and extension could both be 8" long nominal (plus the amount of overlap at threads) or one piece could be 4" long and the other 12" long (plus the amount of overlap at threads). It is also possible that each piece could be any length shorter than 16" and still be utilized in this application.

It is also possible that the barrel could be in more than two segments, such as three 6" nominal lengths, with the forward-most section having the rear flange for engagement by the elongated (12" long) barrel nut and the middle and rear sections lacking barrel nut engagement but connected to each other. The 12" long barrel nut may itself be two 6" pieces threaded together at a midpoint to provide a system with short component length for stowage.

Although no specific construction method is claimed, it may be that a certain manufacturing approach is favored in order to provide repeatable connections, ease of use, and an accurate barrel. Traditional means of manufacture could be employed such as drilling, button rifling, broaching, threading, etc.

I claim:

1. A firearm comprising:

a frame having a barrel mount facility;

the barrel mount facility having a barrel engagement portion and a threaded portion;

a rear barrel portion having a rear end defining a chamber and configured to connect to the barrel engagement portion;

the rear barrel portion having a front end having a first mating facility;

a forward barrel portion having a rear end having a second mating facility configured to connect to the first mating facility;

the forward barrel portion having a first retention facility proximate the rear end;

an elongated barrel nut having a forward end with a second retention facility configured to bias the first retention facility in a rearward direction, the barrel nut having a rear end having nut threads configured to connect with the threaded portion of the frame.

2. The firearm of claim 1 wherein the barrel nut is free of contact with the rear barrel portion.

3. The firearm of claim 1 wherein the first retention facility is a forward-facing shoulder surface.

4. The firearm of claim 1 wherein the forward barrel portion and the rear barrel portion form a barrel assembly having a length greater than a preselected threshold.

5. The firearm of claim 4 wherein each of the forward barrel portion and the rear barrel portion has a length less than the preselected threshold.

6. The firearm of claim 5 wherein the preselected threshold is 16 inches.

7. The firearm of claim 1 wherein at least one of the forward barrel portion and the rear barrel portion has a rifled bore.

* * * * *